US005236327A

United States Patent [19]

Flanagan et al.

[11] Patent Number: 5,236,327

[45] Date of Patent: Aug. 17, 1993

[54] LOW $NO_x$ BURNER

[75] Inventors: Paul Flanagan, Northfield Center; Kenneth M. Gretsinger, Streetsboro, both of Ohio

[73] Assignee: American Gas Association, Independence, Ohio

[21] Appl. No.: 869,735

[22] Filed: Apr. 16, 1992

Related U.S. Application Data

[63] Continuation-in-part of Ser. No. 614,581, Nov. 16, 1990, abandoned.

[51] Int. Cl.[5] ..... F23D 14/46

[52] U.S. Cl. ..... 431/12; 431/350; 431/353; 239/590

[58] Field of Search ..... 431/2, 8, 350, 353, 431/346; 239/553, 590

[56] References Cited

U.S. PATENT DOCUMENTS

| | | | |
|---|---|---|---|
| 1,596,667 | 8/1926 | Levey et al. | 431/346 |
| 2,510,482 | 6/1950 | Scharbau et al. | 431/353 |
| 2,581,075 | 1/1952 | Buck | 431/357 |
| 3,084,736 | 4/1963 | Mentel et al. | 431/347 |
| 3,129,749 | 4/1964 | Honger | 431/329 |
| 3,245,459 | 4/1966 | Keith | 431/329 |
| 3,258,058 | 6/1966 | Lherault et al. | 431/329 |
| 3,331,293 | 7/1967 | Mullaney | 431/329 |
| 3,544,255 | 12/1970 | Roper | 431/350 |
| 3,817,690 | 6/1974 | Bryce et al. | 431/350 |
| 3,847,536 | 11/1974 | Lepage | 431/329 |
| 4,067,686 | 1/1978 | Karpisek | 431/353 |
| 4,861,261 | 8/1989 | Krieger | 431/1 |

*Primary Examiner*—Carroll B. Dority
*Attorney, Agent, or Firm*—James A. Hudak

[57] ABSTRACT

A burner structure and a method of operating a burner to reduce the pollutant emissions produced thereby are disclosed. Air and gas are premixed in a manner such that a substantially homogeneous mixture containing excess combustion air results. The velocity of the substantially homogeneous mixture is increased as it passes through the burner causing the "residence time" associated with the formation of the flame to be decreased, i.e., the combustion gases are in the reaction zone of the flame for a significantly shorter period of time, reducing the production of $NO_x$. In order to prevent the flame from "lifting-off" the burner because of the high velocity of the substantially homogeneous air/gas mixture, flame stabilizing devices and/or a burner structure which provides flame stabilization are utilized resulting in the production of a high heat flux and low pollutant emissions.

9 Claims, 7 Drawing Sheets

CHARACTERISTIC COMBUSTION
STABILITY LOOPS

CALCULATED NO
FORMATION RATES VS.
TIME AND TEMPERATURE

EFFECT OF RESIDENCE TIME ON NOx IN A PREMIXED FUEL-AIR SYSTEM

AIR/GAS DISTRIBUTION DETAIL

LOW $NO_x$ BURNER

This is a continuation-in-part of copending application Ser. No. 07/614,581 filed on Nov. 16, 1990 abandoned.

TECHNICAL FIELD

The present invention relates, in general, to combustion apparatus and, more particularly, to apparatus and a combustion technique that produces an extremely low level of $NO_x$ emissions.

BACKGROUND ART

Recently, there has been a great deal of concern over the problem of air pollution. This problem is particularly acute in the urban areas of the country. There are many sources of air pollution such as the internal combustion engine, chemical processing plants, power generating facilities, etc. One of the more serious pollutants is the oxides of nitrogen, such as NO and $NO_2$, which are collectively known as $NO_x$ and which contribute to air pollution by the formation of smog. Other pollutants, principally carbon monoxide (CO) and to a lesser extent unburned hydrocarbons (HC), also contribute to the environmental burden. Of all the pollutants resulting from fossil fuel combustion, experience has shown that $NO_x$ is one of the most difficult to minimize. Even though reductions in $NO_x$ are difficult to achieve, recently enacted pollution abatement standards as set forth in Rule 1146.1 of the South Coast Air Quality Management District (SCAQMD) establishes emission limits of 30 parts per million by volume (ppmv) for $NO_x$ and 400 ppmv for CO, both levels corrected to 3% exhaust oxygen content.

In fuel burning facilities, such as power generating stations, there are various sources of $NO_x$ emissions. One source of $NO_x$ emissions, referred to as thermal NO, results from the oxidation of the diatomic nitrogen ($N_2$) component in the combustion air. Thermochemistry requires temperatures typically in the order of 2800° F. (1810° K.) for the formation of NO in this manner. The diatomic nitrogen ($N_2$) component must first be dissociated into atomic nitrogen (N) prior to the formation of NO. Another source of $NO_x$ emissions, referred to as fuel NO, results from the fact that many fuels contain the single atomic nitrogen species, for example, ammonia ($NH_3$). In this case, $N_2$ bond splitting is not a prerequisite for NO formation thereby allowing conversion of fuel-bound nitrogen into NO at temperatures significantly below 2800° F. (1810° K.). Conversion of fuel-bound nitrogen into NO can occur at temperatures as low as 1300° F. (977° K.). Still another source of $NO_x$ emissions, referred to as prompt NO, results from high-speed reactions. Formation of NO by high speed reactions in fuel rich zones in the flame front have been reported and is the subject of ongoing research. No widely accepted mechanism for this phenomena has been developed.

In those geographic areas where stringent air quality control regulations have been enacted, such as those areas included within the SCAQMD, it has become extremely difficult to reach the standards established for $NO_x$ emissions by utilizing presently available burners and/or methods of operating same. Various approaches have been developed for reducing $NO_x$ emissions, however, the resulting reduction in emissions is not sufficient in many cases to satisfy the foregoing stringent air quality standards. Some of these approaches are based on reducing $NO_x$ emissions by multi-stage combustion. For example, such multi-stage combustion might involve burning a first fuel as a "lean mixture" and subsequently burning the resulting combustion products with a second fuel to form an atmosphere which causes a reduction in $NO_x$ emissions. Alternatively, fuel and air can be introduced into a burner so as to form two separate streams each having different of fuel to air ratios, i.e., one stream would have an excess of air while the other stream would have an excess of fuel. One of the streams is then ignited effecting a first stage of combustion which then ignites the second stream effecting a second stage of combustion. A third stage of combustion is provided by mixing and burning the excess fuel in one of the streams with the excess air in the other of the streams. A still another approach to reduce $NO_x$ emissions requires a plurality of burners disposed in a series connection with respect to the direction of flow of combustion air. In this case, the last burner in the series of burners utilizes a fuel having lower $NO_x$ producing properties.

Decreasing the temperature of combustion can also result in a reduction in $NO_x$ emissions. The combustion temperature can be reduced by direct flame cooling through water injection of the combustion gases or by adding a cooling gas to the air/gas mixture. Flame temperature can also be reduced by utilizing radiant burners which are, most often, essentially surface combustors employing ceramic fibers, metallic fibers or reticulated ceramic foams as the radiant surface. A major disadvantage of most surface combustors is that because of their large size, a substantial volume of air/gas mixture is trapped within the burner. In the event of flashback, which is a distinct possibility and which adversely affects the applicability of such combustors, the deflagration created may be of explosive proportions. Another disadvantage of surface combustors is that to achieve optimal radiant output for a given input (radiant efficiency), the surface temperature must remain extremely high. Surface combustion temperatures are very sensitive to air/fuel ratio, velocity, and flow uniformity. A reduction in surface temperature diminishes the radiant output by the fourth power which would likely result in higher $NO_x$ emissions levels, via higher flame temperatures.

$NO_x$ emissions can also be reduced by recirculating the flue gases within the combustion chamber. In this approach, a portion of the flue gases can either be mixed with the combustion air prior to combustion, or delivered into the combustion zone separately. The recirculated flue gas acts as a diluent to lower the overall oxygen concentration and flame temperature. In essence, the combustion air supply is vitiated, thus reducing $NO_x$, however, carbon monoxide (CO) emissions might increase. Flue gas recirculation (FGR) also has an adverse effect on the efficiency of the combustion process in much the same manner as excess combustion air.

Another approach for reducing the production of $NO_x$ involves changing the composition of the air/gas mixture. For example, if a mixture of oxygen and an inert gas, other than nitrogen, is utilized as the combustion atmosphere, $NO_x$ emissions are reduced. Alternatively, an additive can be introduced into the combustion chamber to form reducing agents which react with the nitrogen oxides to produce nitrogen, thus reducing the production of $NO_x$. Thus, there are many approaches for reducing $NO_x$ emissions.

All of the foregoing approaches for reducing $NO_x$ emissions have certain inherent disadvantages with respect to cost, reliability, performance, etc. For example, reducing the combustion temperature to reduce the production of $NO_x$ may result in a reduction in the heat flux produced by the burner. Multi-stage combustion usually requires a significant amount of equipment and associated controls, all of which can be quite costly. Similarly, flue gas recirculation techniques require additional equipment and might increase the production of carbon monoxide (CO), whereas the use of additives increases operating costs. Radiant process fibrous materials are expensive, often fragile, and sensitive to blockage from airborne dust, thus requiring filtration equipment and associated maintenance. Such air filtration equipment will not prevent burner plugging problems inherent in the combustion of numerous fuels which contain contaminants, such as tar.

It is well established that thermal NO formation is the predominant $NO_x$ producing mechanism in the combustion of clean fuels, e.g., natural gas, and that the Zeldovich chain reaction mechanism applies to thermal NO formation. The chemical reaction kinetics of this analytical model predict that $NO_x$ production increases with time and temperature. These trends have been verified in practical combustion systems with peak $NO_x$ formation rates occurring slightly to the fuel lean side of stoichiometric. Reducing the combustion reaction (flame) temperature by using an excess of combustion air or FGR can, in certain cases, result in lower $NO_x$ formation. This effect can only be used to significant advantage with a homogeneous pre-mix type combustion apparatus; in chemical parlance, a plug flow reactor. In the plug flow method, the peak fuel to air concentration equals the average concentration due to the premixing. This results in the average flame temperature being equal to the peak flame temperature. The $NO_x$ emissions are then proportional to this temperature level. In a nozzle mixing burner (stirred reactor), the mixing and combustion reactions occur virtually simultaneously, and due to mixing imperfections, wide variations in fuel to air concentrations occur. This results in mixture stratification with some localized peak fuel to air concentrations significantly in excess of the overall average value. Where the higher concentrations occur, high temperatures result, with concurrent high levels of $NO_x$ formation.

Pre-mix combustion systems also offer the advantage of a high heat release rate per unit of combustion volume as compared to nozzle mix systems. In other respects, they are inferior to nozzle mixing systems; particularly with respect to combustion stability limits. Beyond certain air to fuel ratio values, combustion moves away from the burner apparatus and the flame is extinguished. These effects are illustrated in FIG. 1, in which it can be seen that pre-mix burners have a limited stability range in the more useful fuel lean non-polluting operating range. Also, for all burner types, as the stability limits are approached, the combustion efficiency decreases prior to flame extinction or "blow-out". The reduction in combustion efficiency produces large amounts of unburned combustible pollutants, predominately CO in the case of natural gas combustion.

The concept of "residence time" upon $NO_x$ formation has not attracted significant attention. Predictions of the relative contributions of time and temperature in the formation of NO using the Zeldovich chain reaction model are illustrated in FIG. 2. This Figure also illustrates the importance of "residence time" in the formation of $NO_x$. At a flame temperature of 3400° F. (2144° K.), "residence times" of 0.1, 0.7 and 4.5 seconds produce $NO_x$ levels of 100 ppmv, 1000 ppmv and equilibrium levels, respectively, all of which exceed SCAQMD emissions standards (Rule 1146.1). The dependency between time and temperature in the formation of $NO_x$ is also illustrated in FIG. 3 which shows that as temperature is increased (equivalence ratio above 0.4), $NO_x$ formation is dependent upon "residence time".

In addressing the $NO_x$ problem, it is necessary that $NO_x$ and CO be considered simultaneously, because a reduction in one pollutant may merely represent a compromise with respect to emissions of the other. For most conventional burners, CO and $NO_x$ emissions are generally produced in inverse proportions. Whereas the elimination of carbonaceous pollutants, e.g., CO, etc., is amenable to relatively simple techniques, the simultaneous control of both $NO_x$ and CO has presented problems using generally accepted control techniques. This problem occurs since CO requires time and a relatively high temperature, typically of the order of 2500° F. (1644° K.), to oxidize such to carbon dioxide ($CO_2$). Temperatures in excess of 2800° F. (1810° K.) have been found to be conducive to $NO_x$ formation. These factors can be understood by referring to FIG. 4 which is a graph of the $NO_x$ versus combustibles, such as CO, and illustrates the "emissions window" in which burners are considered to be operating within currently acceptable emission levels.

To sustain clean, efficient combustion, a region of stable burning must be created. In the absence of such, flame extinction or "blow-out" will occur. Combustion efficiency and flame stability are closely interrelated, the "blow-out" condition representing the case of zero combustion efficiency. Flame stabilization can be achieved by the use of a flame holding device or bluff body in the air/gas mixture stream. Typical flame stabilizing devices include metal screens, rods, and flame inserts. It has been found that these flame stabilizing devices also reduce $NO_x$ emissions. Radiant fiber and ceramic surface burners have also been used for similar reasons. In the foregoing cases, the rods or surfaces provide a heat absorbing mechanism capable of reradiating the absorbed heat to an absorbing surface beyond the flame region. By such means the flame temperature is reduced with concurrent reductions in $NO_x$ formation. A key element in this approach is the ability of the radiant emitter surface to remove a substantial proportion of the heat generated, thereby controlling flame temperature. Experimental evidence of this phenomena shows an increase in $NO_x$ emissions as the heat flux to the emitter is increased. This since, for a fixed emitter geometry, i.e., surface area, the amount of heat radiation from the reaction zone is essentially constant, thereby impairing its ability to control the reaction temperature at the higher heat flux rates. Surface burners change from radiant to a blue flame mode as the heat flux (BTU/hr/ins$^2$) is increased. In general, at heat fluxes in excess of 1000 BTU/hr/ins$^2$, the more common surface burners "blow-out"; prior to this large quantities of CO are also produced.

In view of the foregoing, it has become desirable to develop a burner structure and/or a methodology for operating same which minimizes the production of $NO_x$ and produces low levels of CO so as to remain within the "emissions window" throughout the firing range from low to high fire.

SUMMARY OF THE INVENTION

It is known that the use of excess combustion air in pre-mixed burners reduces $NO_x$ emissions since such excess air decreases the temperature of combustion. In accordance with the present invention, it has been found that increasing the velocity of the air/gas mixture also reduces $NO_x$ emissions since "residence time" at the combustion reaction temperature is decreased. The air/gas mixture, however, must be substantially homogeneous to obtain significant reductions in $NO_x$ emissions. The importance of this latter factor, i.e., the homogeneity of the air/gas mixture, has not been previously stressed and/or recognized by those skilled in the art. Increasing the velocity of the air/gas mixture does create a problem of flame "lift-off" from the burner. To prevent the occurrence of flame "lift-off" while minimizing $NO_x$ production, a flame stabilizing device and/or a burner structure which provides flame stabilization should be employed. The flame stabilizing devices may be constructed from any suitable configuration of heat resistant materials. Flame stabilization can also be achieved by aerodynamic means, e.g., opposed jet impingement or recirculation, wake flow, etc., eliminating the need for mechanical stabilizing devices. Experiments were conducted at high heat flux rates using various types of burners, such as ribbon, ported ceramic, and porous ceramic burners. Regardless of the type of flame stabilization device utilized and/or burner design employed to provide flame stabilization, the resulting $NO_x$ and CO emissions were very low utilizing the methodology of the present invention.

BRIEF DESCRIPTION OF THE DRAWINGS

FIG. 11 is a cross-sectional view of one type of pre-mix burner utilizing internal flame stabilization apparatus and which can be operated using the methodology of the present invention.

FIG. 12 is a cross-sectional view of another type of pre-mix burner utilizing internal flame stabilization apparatus and which can be operated using the methodology of the present invention.

DESCRIPTION OF THE PREFERRED EMBODIMENT

The production of $NO_x$ is a function of combustion temperature, the time required to complete combustion and the homogeneity of the air/gas mixture. The importance of this latter factor, i.e., the homogeneity of the air/gas mixture, has generally not been recognized in the gas industry. The use of excess combustion air in a substantially homogeneous air/gas mixture decreases the production of $NO_x$. The reduction in $NO_x$ production in this case can be attributed to a decrease in the temperature of combustion as a result of the excess air. Alternatively, increasing the velocity of the resulting air/gas mixture to between 30 to 120 feet per second (fps) can reduce $NO_x$ emissions. By increasing the velocity of the air/gas mixture, the "residence time" associated with the formation of a flame is decreased, i.e., the combustion gases are in the reaction zone of the flame for a significantly shorter period of time which, in turn, reduces the production of $NO_x$. The velocity of the air/gas mixture can only be increased to a level where the flame begins to "lift-off" the burner. Increasing the velocity of the air/gas mixture beyond the foregoing level results in the flame being blown out. In order to increase the velocity of the air/gas mixture beyond the velocity where flame "lift-off" occurs, a flame stabilizing device or a burner structure which provides flame stabilization must be utilized. The use of such flame stabilizing techniques creates a combustion sustaining quiescent zone within the substantially homogeneous air/gas mixture. The velocity of the substantially homogeneous air/gas mixture within the combustion sustaining quiescent zone is less than the velocity of the air/gas mixture outside the zone which is greater than the velocity at which flame "lift-off" occurs when flame stabilization is not employed.

Figure 5:
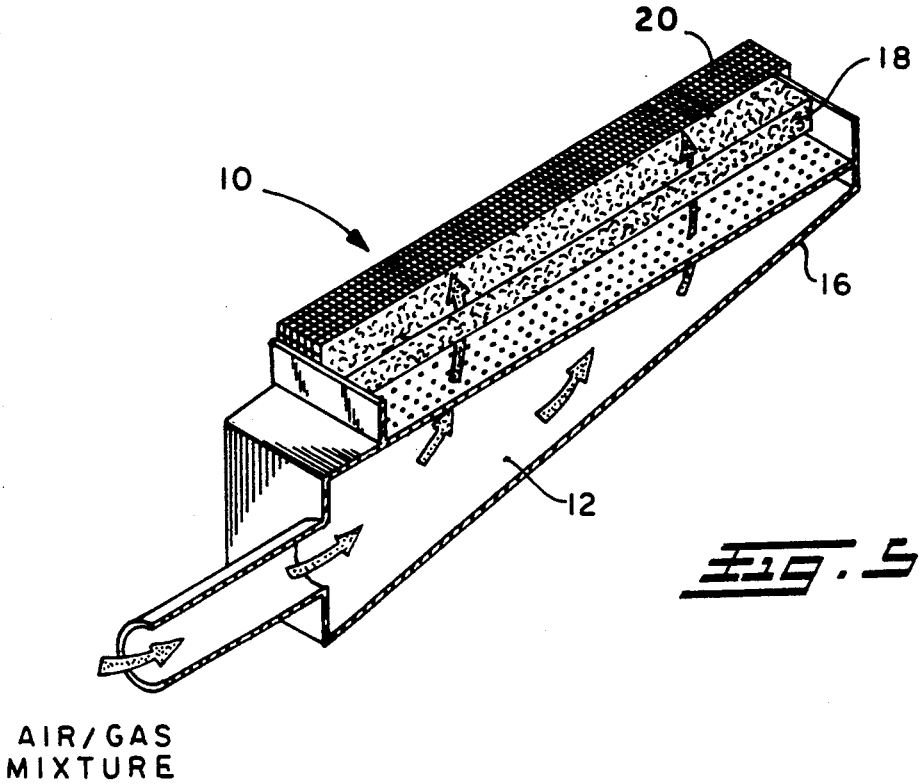
FIG. 5 is a cross-sectional view of one type of pre-mix burner utilizing external flame stabilization apparatus and which can be used to demonstrate the methodology of the present invention.
Figure 6:
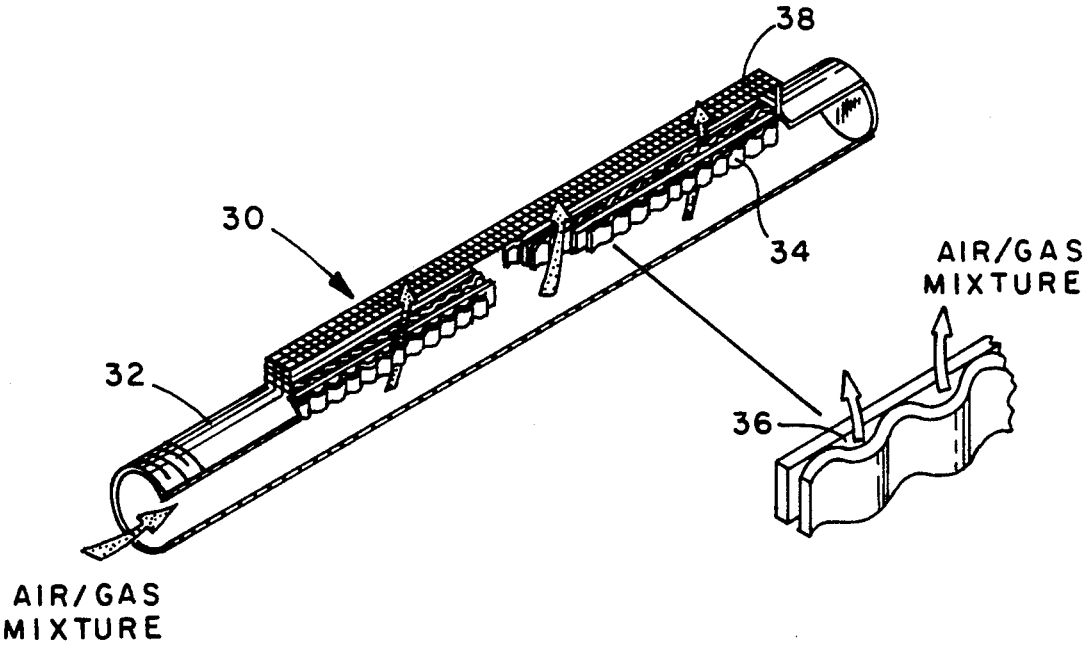
FIG. 6 is a cross-sectional view of another type of pre-mix burner utilizing external flame stabilization apparatus and which can be used to demonstrate the methodology of the present invention.

Referring to the drawings, FIG. 5 is a cross-sectional view of one of a number of burner units 10 which utilizes an external flame stabilizing device and which can be used to demonstrate the methodology of the present invention to produce a low level of $NO_x$ emissions. The burner unit 10 includes a plenum 12 with a distribution plate 14 extending across its upper surface forming the outlet of the burner. The distribution plate 14 has a plurality of orifices or ports 16 passing therethrough. A flame arrester/distributor matrix 18 is positioned adjacent the upper surface of the distribution plate 14 and a wire mesh flameholder 20 is positioned exteriorly of the flame arrester/distributor matrix 18. Another embodiment of a burner unit which utilizes an external flame stabilizing device and which can be used to demonstrate the methodology of the present invention so as to produce a low level of $NO_x$ emissions is burner unit 30, illustrated in FIG. 6. Burner unit 30 includes a burner body 32 and a plurality of parallel flame arrester/distributor ribbons 34 adjacent its upper surface forming ports 36 therebetween. As in the embodiment illustrated in FIG. 5, a wire mesh flameholder 38 is positioned exteriorly of the flame arrester/distributor ribbons 34. The foregoing burner units are merely examples of some types of burners that utilize external flame stabilization apparatus and can be used to demonstrate the methodology of the present invention, hereinafter described, to produce very low levels of $NO_x$ emissions. Regardless of the type of burner utilized, the plenum or burner body is connected to an air/gas supply. In this manner, a substantially homogeneous air/gas mixture is supplied to the plenum or burner body. One or more flame stabilizing devices are positioned a short distance above the ports in the burner units and may include one or more ceramic flame rods, wire mesh flame screens, or any combination thereof, in order to stabilize the flame. It should be noted that in addition to stabilizing the flame, the flame stabilizing devices may also produce radiant heat which suppresses $NO_x$ formation.

Figure 7:
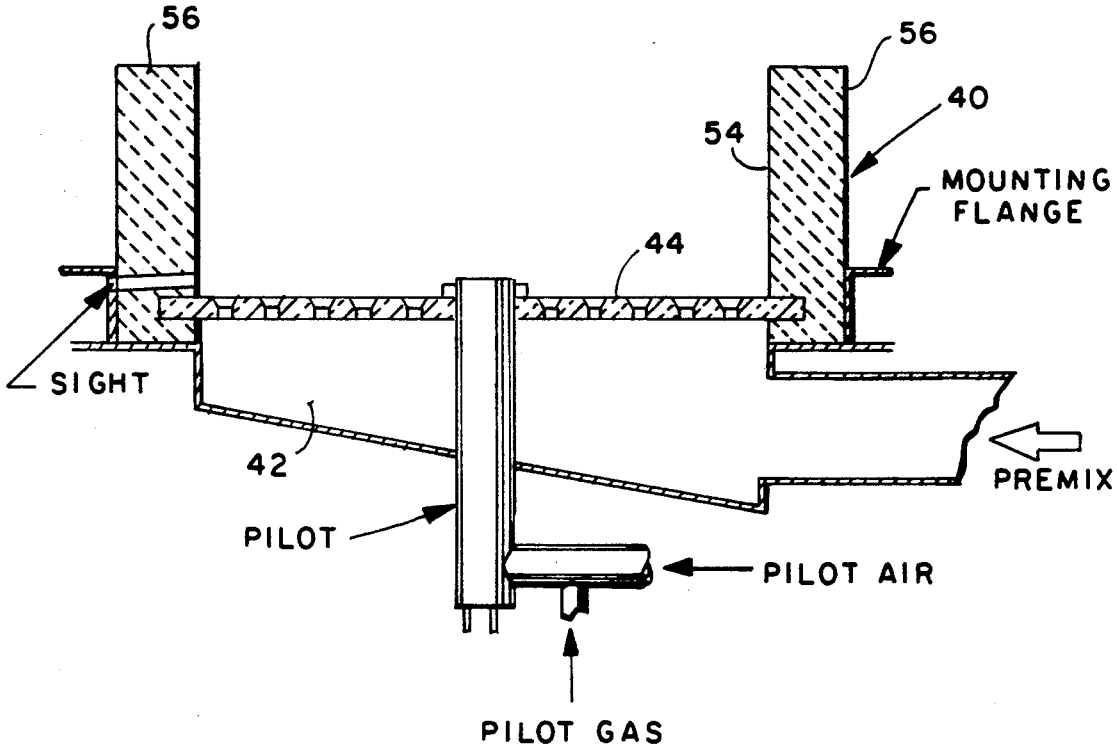
FIG. 7 is a cross-sectional view of one type of pre-mix burner wherein flame stabilization is achieved by the design of the burner and which can be operated using the methodology of the present invention.
Figure 8:
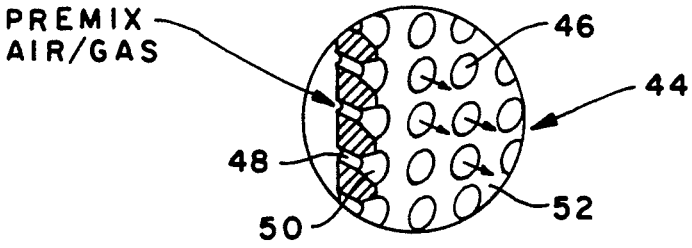
FIG. 8 is an enlarged partial cross-sectional view of the distribution plate illustrated in FIG, 7 and illustrates the configuration of the ports therein.

An embodiment of a burner unit which utilizes its structure to provide flame stabilization and which can be operated according to the methodology of the present invention to produce a very low level of $NO_x$ emissions is burner unit 40, illustrated in FIG. 7. Burner unit 40 includes a plenum 42 with a ceramic tile distribution plate 44 extending across its upper surface forming the outlet of the burner. The distribution plate 44 has a plurality of orifices or ports 46 therein, as illustrated in FIG. 8. Each port 46 has a through portion 48 of substantially constant diameter and may incorporate a tapered portion 50 of increasing diameter from its junction with through portion 48 to the outer surface 52 of the distribution plate 44. The distribution plate 44 is positioned within a recess 54 formed by refractory material 56. The recess 54 effectively acts as a flame stabilizer by causing recirculation of the combustion products in a direction substantially perpendicular to the flow of the air/gas mixture through the burner unit 40, thus minimizing flame "lift-off" from the distribution plate 44.

Figure 9:
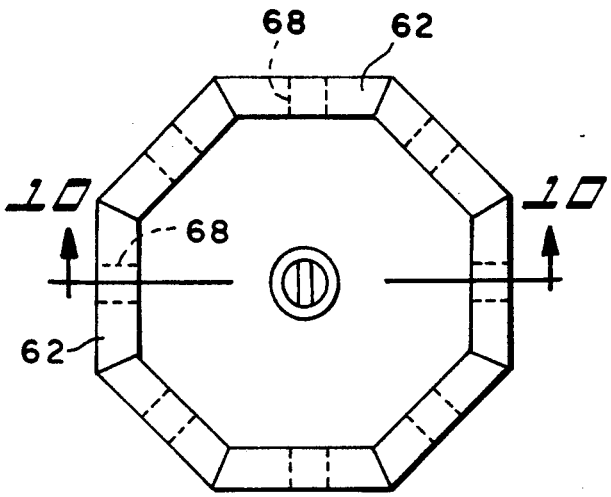
FIG. 9 is a top plan view of the distribution plates utilized in another type of pre-mix burner wherein flame stabilization is achieved by the design of the burner and which can be operated by the methodology of the present invention.
Figure 10:
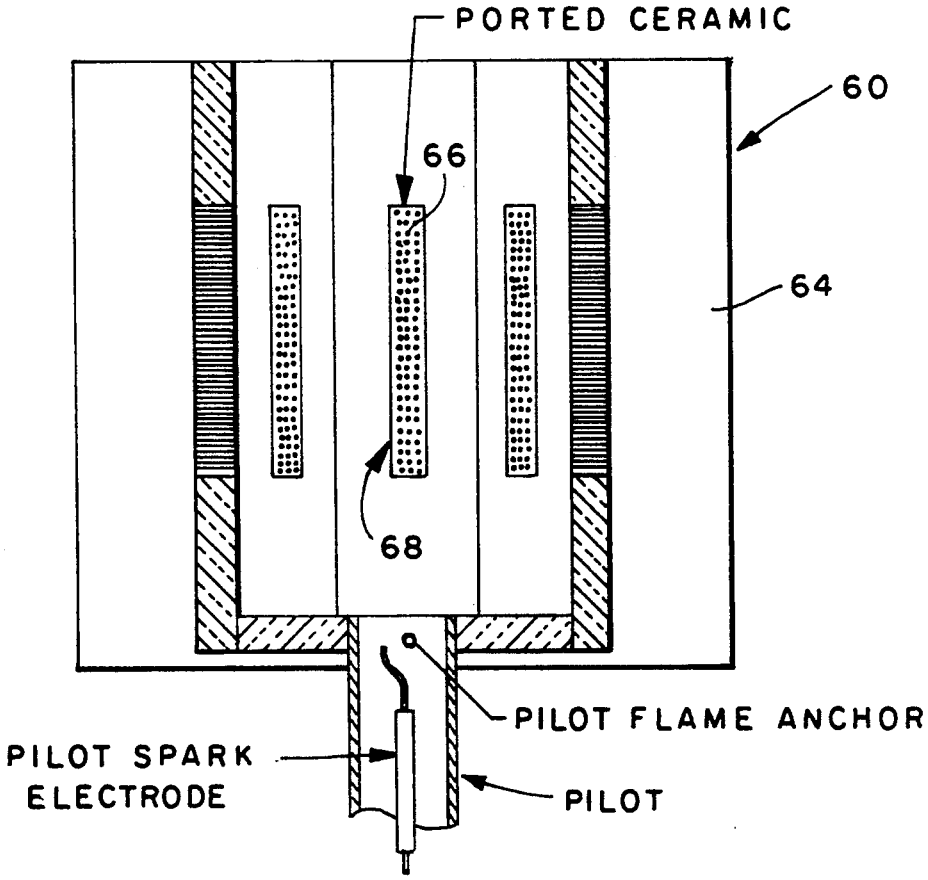
FIG. 10 is a cross-sectional view taken across section-indicating lines 10—10 of FIG. 9 illustrating the distribution plates and including the plenum which surrounds same.
Figure 6E:
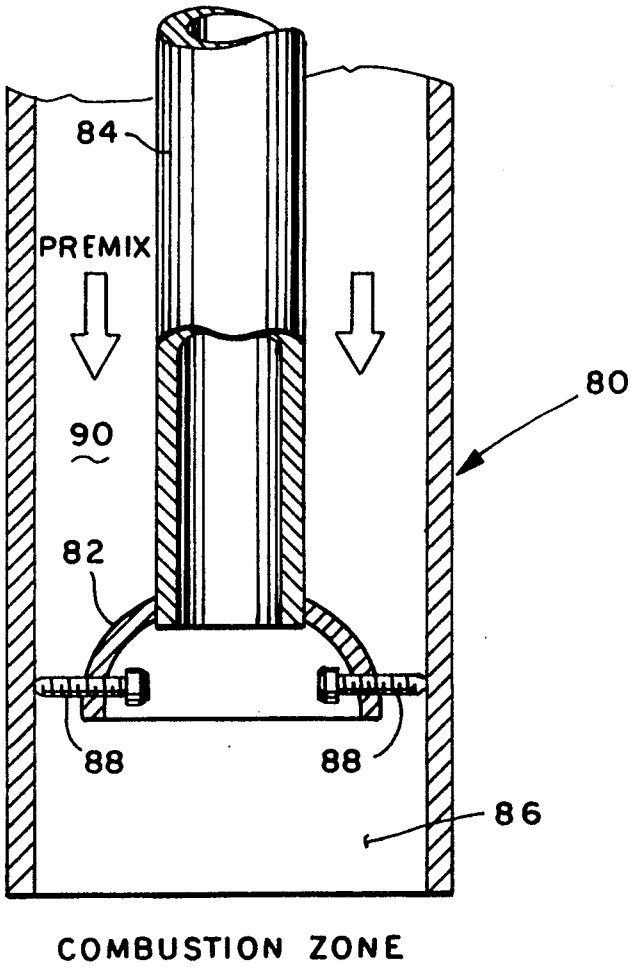
Figure 6F:
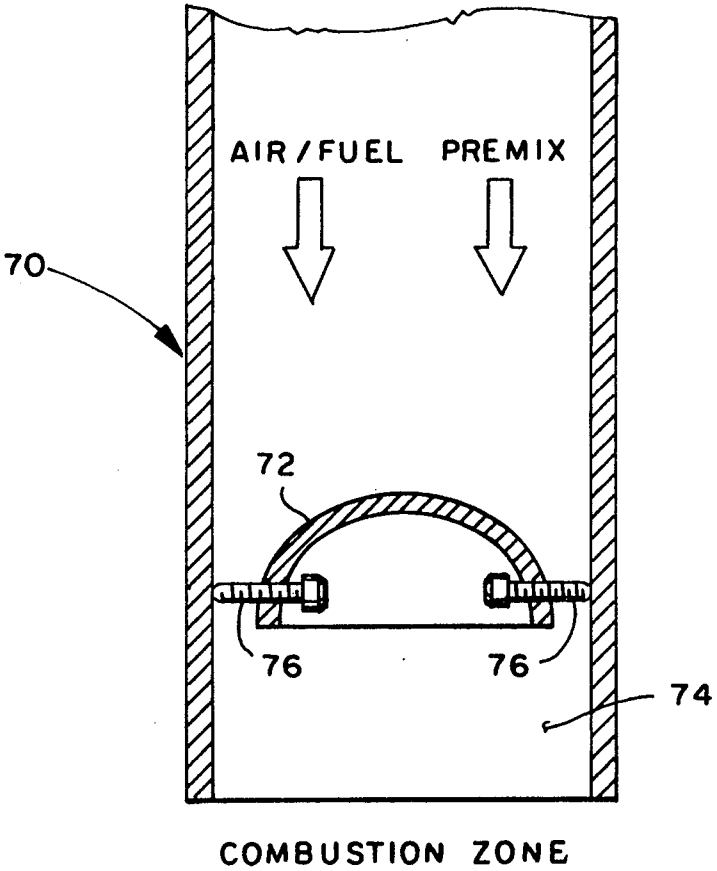

Another embodiment of a burner unit which utilizes its structure to provide flame stabilization is burner unit 60, illustrated in FIGS. 9 and 10. In this embodiment, a plurality of distribution plates 62 formed from refractory material are disposed in an upright position and arranged "edge-to-edge" in a geometric configuration, such as a hexagon. A plenum 64 surrounds the plurality of distribution plates 62 and is connected to an air/gas supply (not shown). Each distribution plate 62 has a plurality of orifices or ports 66 therein which may have a configuration similar to the ports 46 provided in distribution plate 44 illustrated in FIG. 8. A portion of the ports 66 in each distribution plate 62 is blocked off providing a localized area of ports, shown generally by the numeral 68, through which the air/gas mixture passes resulting in a flame adjacent thereto. The orientation of the distribution plates 62 relative to one another causes the resulting flames to impinge upon each other minimizing flame "lift-off" from the plates 62.

An embodiment of a burner unit which utilizes internal flame stabilization apparatus and which can be operated according to the methodology of the present invention to produce a low level of $NO_x$ emissions is burner 70, illustrated in FIG. 11. If a burner has a single outlet or a relatively small number of outlet ports, such as burner 70, a bluff body 72 can be located within the outlet 74 or within each outlet port of the burner. The bluff body 72 can be formed from any of a variety of geometries, e.g., a weld cap having a generally semispherical configuration, or the like, which is held within the outlet 74 of the burner by means of set screws 76 which are threadably received through the bluff body 72 so that their ends contact the inner surface of the burner 70. Bluff body 72 is positioned within the outlet 74 so that the flow of the air/gas mixture contacts the convex surface of same. In this manner, the bluff body 72 presents a contoured obstruction to the flow of the air/gas mixture. A separate pilot (not shown) is utilized to ignite the air/gas mixture and the velocity of the air/gas mixture approaches the velocity at which the flame begins to "lift-off" the surface defining the outlet 74 of the burner 70. It should be noted that flow of the air/gas mixture impinges upon the upstream face of the bluff body 72, and then recirculates counter to the air/gas flow direction in a zone on the downstream side of the bluff body creating a region which supports combustion before passing outwardly therefrom to the outlet 74 of the burner 70.

Another burner structure which utilizes internal flame stabilization is burner unit 80, illustrated in FIG. 12. In this embodiment a bluff body 82 is attached to the end of a pilot tube 84. Here again, the bluff body 82 can be formed from any of a variety of geometries, e.g., a weld cap having a generally semispherical configuration, or the like. Alternatively, the pilot tube 84 and the bluff body 82 can be formed from a pipe and a reducing coupling. The pilot tube 84 and bluff body 82 are received within the outlet 86 of the burner 80 and are held within same by means of set screws 88 which are threadably received through the bluff body 82 so that their ends contact the inner surface of the burner 80. The pilot tube 84 and the bluff body 82 are positioned within the burner 80 so as to be substantially concentric therein. The air/gas mixture passes through a passageway 90 between the outer surface of the pilot tube 84 and the inner surface of burner 80 and the mixture impinges upon the upstream face of the bluff body 82, and then recirculates counter to the air/gas flow direction in a zone on the downstream side of the bluff body 82 creating a region which supports combustion. After ignition of the air/gas mixture by the pilot flame provided by the pilot tube 84, the resulting combustion gases pass to the outlet 86 of the burner 80. As in the burner structure illustrated in FIG. 11, the velocity of the air/gas mixture approaches the velocity at which the flame begins to "lift-off" the surface forming the outlet 86 of the burner 80. It has been demonstrated that the foregoing bluff bodies in FIGS. 11 and 12 provide flame stabilization, permitting the velocity of the air/gas mixture to be increased beyond the velocity at which flame "lift-off" would occur if a flame stabilizing device had not been used. It has also been found that the use of such bluff bodies negates the need for a stabilizing device exterior to the outlet of the burner.

Figure 13:
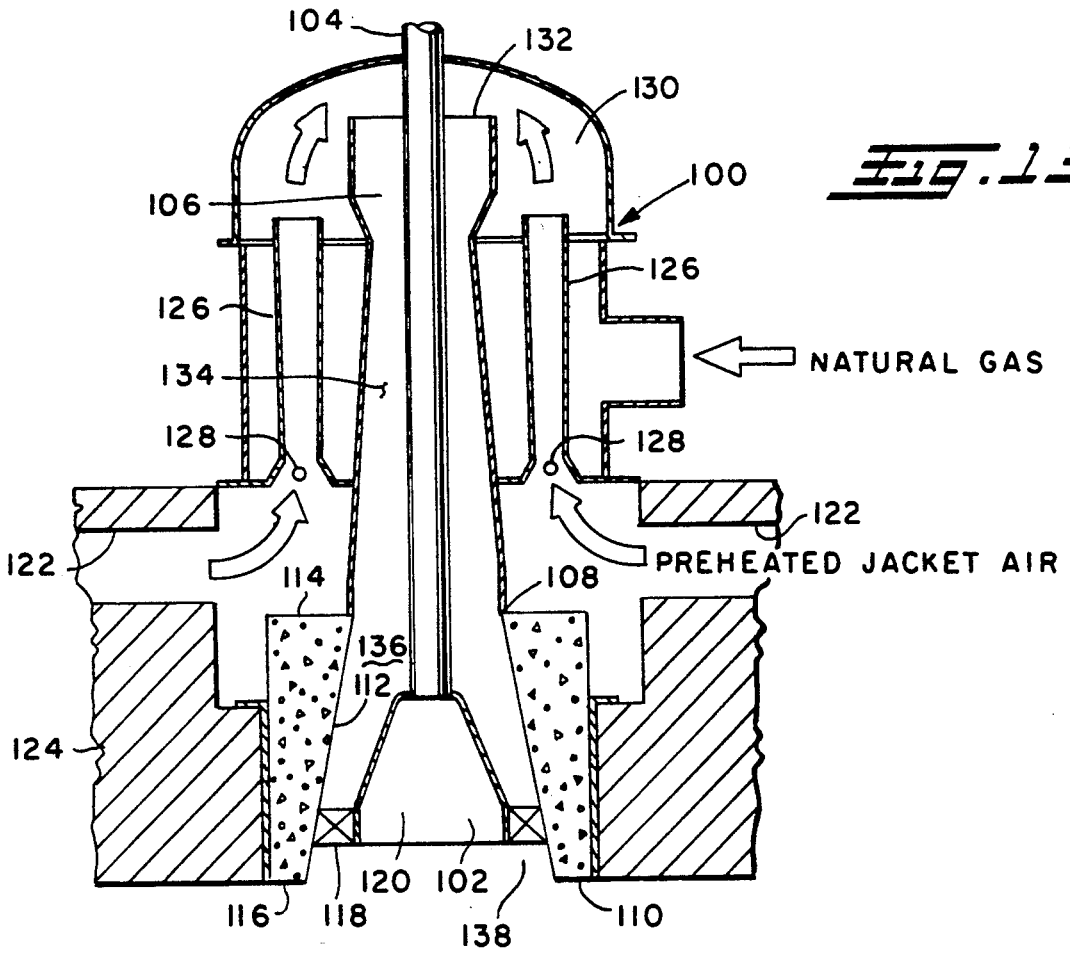
FIG. 13 is a cross-sectional view of still another type of pre-mix burner utilizing internal flame stabilization apparatus and which can be operated using the methodology of the present invention.

A still another burner structure which incorporates internal flame stabilization is burner unit 100, illustrated in FIG. 13. In this embodiment a flameholder 102 is attached to the end of a pilot tube 104. The flameholder 102 can be cup-shaped and acts as a bluff body, as in the structures illustrated in FIGS. 11 and 12. The pilot tube 104 is positioned within a pipe 106 so as to be substantially concentric therein. The end 108 of pipe 106 abuts a refractory diffuser 110 having a tapered opening 112 therein. The diameter of the tapered opening 112 increases from the inner surface 114 of the refractory diffuser 110, which abuts end 108 of pipe 106, to the outer surface 116 thereof. The inner diameter of pipe 106 at its end 108 is approximately the same as the diameter of the tapered opening 112 at the inner surface 114 of the refractory diffuser 110. The end 108 of the pipe 106 is aligned with the tapered opening 112 so that no discontinuities exist between the surface defining the inner diameter of the pipe 106 and the surface defining the tapered opening 112 in the refractory diffuser 110. A swirl vane assembly 118 is positioned adjacent the outlet 120 of the flameholder 102 and is interposed between the flameholder 102 and the surface defining the tapered opening 112 in the refractory diffuser 110. Air is provided through apertures 122 provided in the burner housing 124 and passes into a plurality of venturis 126, each provided with a gas inlet 128. Air and gas are mixed within each venturi 126 and the resulting air/gas mixture passes therethrough into a chamber 130 before passing into pipe 106 through end 132 thereof. The air/gas mixture passes through a passageway 134 between the inner surface of the pipe 106 and the outer surface of the pilot tube 104 into a passageway 136 between the surface defining the tapered opening 112 in the refractory diffuser 110 and the outer surface of the flameholder 102. As the air/gas mixture passes through the swirl vane assembly 118, the mixture recirculates counter to the air/gas flow direction in an area on the downstream side of the flameholder 102 creating a region which supports combustion. After ignition of the air/gas mixture by the pilot flame provided by the pilot tube 104, the resulting combustion gases pass outwardly therefrom to the outlet 138 of the burner 100. The velocity of the air/gas mixture approaches the velocity at which the flame begins to "lift-off" the surface forming the outlet 138 of the burner 100. As in the previous burner structures, the flameholder 102 permits the velocity of the air/gas mixture to be increased beyond the velocity at which flame "lift-off" would occur if flame stabilization had not been employed.

Figure 14:
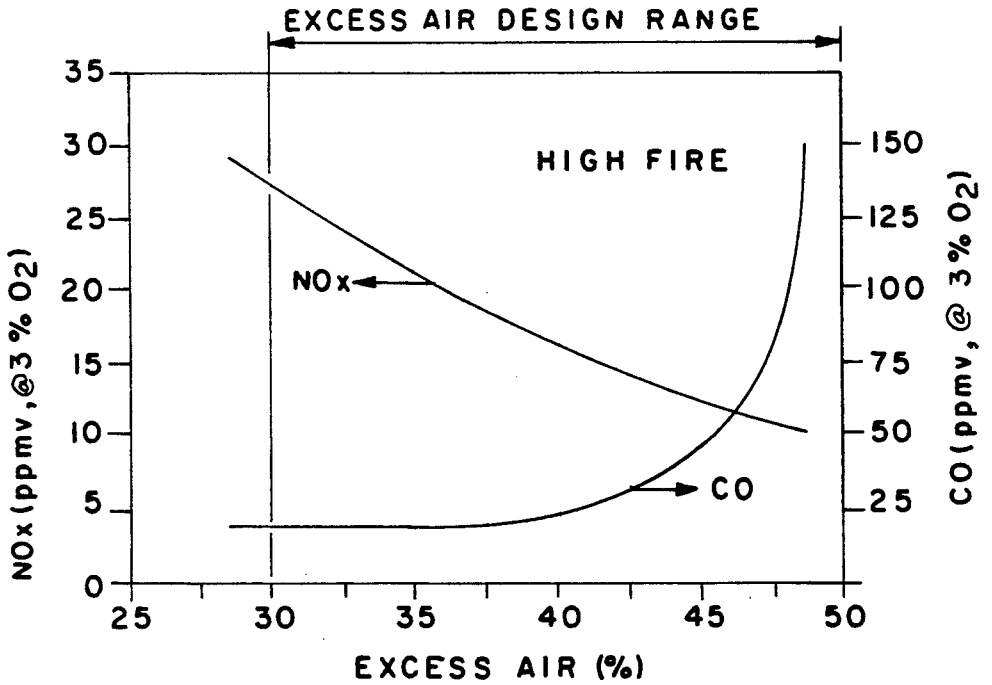
FIG. 14 is a graph of $NO_x$ and CO Emissions versus Percent Excess Air.

Regardless of the burner structure utilized, it has been found that $NO_x$ emissions can be held to acceptable levels by operating the burner unit such that the combustion temperature is slightly below the temperature at which a significant amount of $NO_x$ is produced and the "residence time" associated with the formation of a flame is minimized. It has been found that the foregoing can be achieved only through the use of a substantially homogeneous air/gas mixture to produce a plug flow reaction zone. The importance of air/gas mixture homogeneity cannot be overemphasized to achieve the foregoing results. In the method of the present invention, a high velocity substantially homogeneous air/gas mixture having suitable proportions of excess air has been shown to control the "residence time" and temperature thereby minimizing $NO_x$ emissions. However, because of the high velocity of the substantially homogeneous air/gas mixture, flame stabilizing devices in the form of flame rods, flame screens or bluff bodies and/or a burner structure which provides flame stabilization must be employed to ensure that the flame does not "lift-off" the burner. The use of such flame stabilization techniques creates a combustion sustaining quiescent zone within the substantially homogeneous air/gas mixture. The velocity of the substantially homogeneous air/gas mixture within the combustion sustaining quiescent zone is less than the velocity of the air/gas mixture outside the zone which is greater than the velocity at which flame "lift-off" occurs when flame stabilization is not employed. The devices may also act as a radiator of heat thus keeping the resulting temperature from exceeding the temperature at which a significant amount of $NO_x$ is produced. It should be noted that flame stabilization can also be achieved by aerodynamic means, e.g., opposed jet recirculation, wake flows, etc., eliminating the need for stabilizing devices. Referring now to the graph shown in FIG. 14, it is apparent that $NO_x$ emissions decrease as the percent of excess combustion air increases. If 30 to 50% excess combustion air is utilized, $NO_x$ emissions will be held within recently enacted standards, e.g., substantially below the standards set forth in SCAQMD Rule 1146.1. Thus, with the foregoing operating parameters, viz., 3000° F. (1922° K.) nominal operating temperature, and a high velocity (30 to 120 fps) substantially homogeneous air/gas mixture having excess (30 to 50%) combustion air, permissible $NO_x$ levels can be achieved. It has been further found with the foregoing operating parameters that as heat flux increases, the production of $NO_x$ decreases if "residence time" is minimized. This was not the case with prior art burner systems wherein an increase in heat flux resulted in a commensurate increase in $NO_x$ emissions. This latter benefit, i.e., a decrease of $NO_x$ emissions with an increase in heat flux, has not been previously recognized with respect to domestic commercial/industrial combustion applications.

It has been found in oxygen enriched applications, which generally have higher flame temperature resulting in increased $NO_x$ production, that an increase in the velocity of the substantially homogeneous air/gas mixture having an excess of combustion air decreases "residence time" which, in turn, reduces $NO_x$ production. Similarly, in applications where the foregoing air/gas mixture has been preheated, which typically results in a higher flame temperature, pre-heating increases the velocity of the air/gas mixture resulting in decreased "residence time" and thus, reduced $NO_x$ production.

Figure 1:
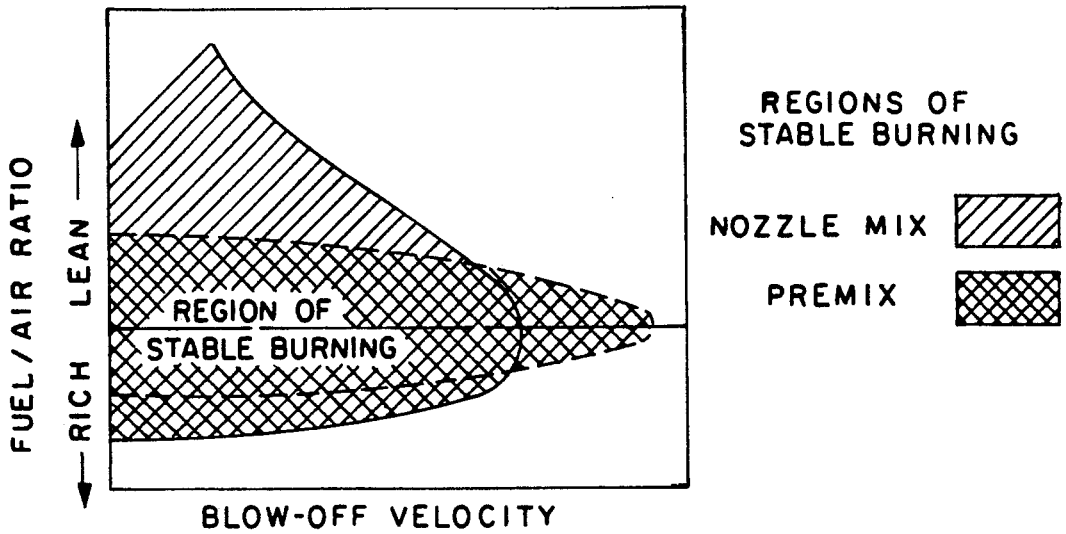
FIG. 1 is a graph of Fuel/Air Ratgionversus Blow-Off Velocity for nozzle mix burners and pre-mix burners.
Figure 2:
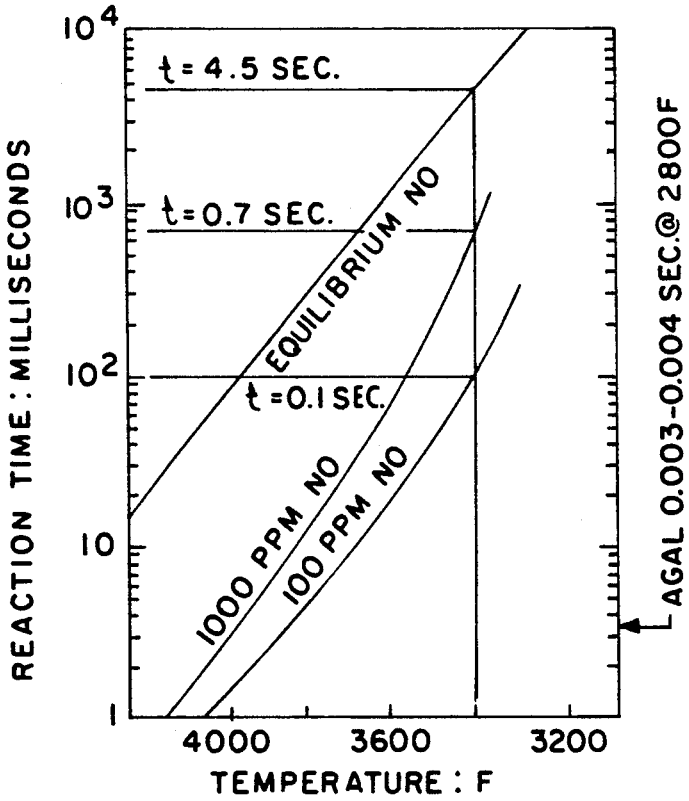
FIG. 2 illustrates the theoretical concentration of $NO_x$ Emissions produced versus Time and Temperature as calculated using the Zeldovich chain reaction model.
Figure 3:
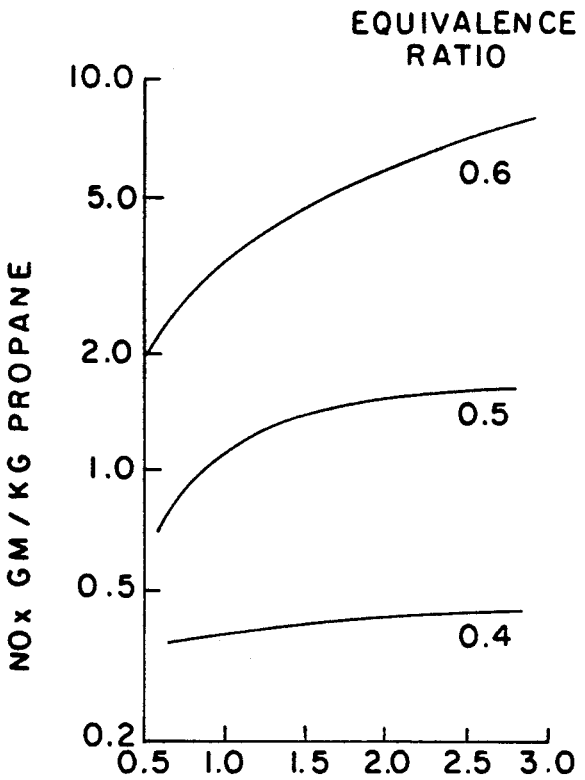
FIG. 3 is a graph of $NO_x$ Emissions versus "Residence Time" in a pre-mixed fuel/air system and illustrates the dependency between time and temperature in the formation of $NO_x$.
Figure 4:
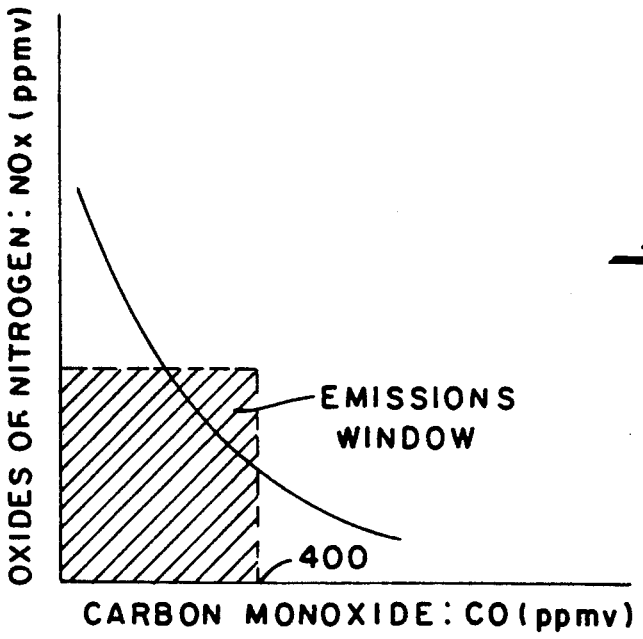
FIG. 4 is a graph of the $NO_x$ Emissions versus Combustibles, such as CO, and illustrates the "emissions window" in which burners are considered to be operating within permissible emission levels.

Another feature of the present invention is that the resulting production of $NO_x$ and CO are within the "emissions window" shown in FIG. 4. As previously stated, conventional burners typically produce $NO_x$ and CO in inverse proportions since time and temperature, both of which are conducive to $NO_x$ formation, are required to reduce CO to $CO_2$. Test results using the methodology of the present invention, i.e., a high velocity (30 to 120 fps) substantially homogeneous air/gas mixture having 30 to 50% excess combustion air, reveal that even though extremely low levels of $NO_x$ are produced, typically below 20 ppmv, the production of CO is not excessive and is within the previously defined "emissions window". Thus, the methodology of the present invention minimizes the production of $NO_x$ while producing low levels of CO.

Certain modifications and improvements will occur to those skilled in the art upon reading the foregoing. It should be understood that all such modifications and improvements have been deleted herein for the sake of conciseness and readability, but are properly within the scope of the following claims.

We claim:

1. A method of operating a gas burner to reduce the $NO_x$ emissions produced thereby, said burner having a passageway therein terminating in an outlet portion, said portion having a substantially constant cross-sectional area, said method comprising the steps of:

a) positioning flame stabilizing means comprising a non-perforated member having a convex surface facing upstream and located within said outlet portion of the burner so as to be totally received therein and substantially obstruct the central portion thereof forming an annular area between the periphery of said flame stabilizing means and the surface defining said outlet portion of the burner;

b) premixing air and gas in a manner such that the resulting mixture is substantially homogeneous and contains excess air;

c) increasing the velocity of said substantially homogeneous air/gas mixture through said passageway to a velocity substantially in excess of the velocity where the flame would lift off the outlet of the burner if said flame stabilizing means is absent;

d) igniting said substantially homogenous air/gas mixture to produce a flame adjacent said annular area and on the downstream side of said flame stabilizing means; and e) continuing the flow of said substantially homogeneous air/gas mixture through said passageway at said velocity substantially in excess of said flame lift off velocity.

2. The method as defined in claim 1 wherein said flame stabilizing means provides a combustion sustaining quiescent zone within said substantially homogeneous air/gas mixture on the downstream side of said flame stabilizing means.

3. The method as defined in claim 2 wherein the velocity of said substantially homogeneous air/gas mixture within said combustion sustaining quiescent zone is less than the velocity of said substantially homogeneous air/gas mixture outside said zone, said velocity of said substantially homogeneous air/gas mixture outside said zone being substantially greater than the velocity at which the flame would lift off the outlet of the burner if said flame stabilizing means is absent.

4. The method as defined in claim 1 wherein said flame stabilizing means comprises a bluff body.

5. A method of operating a gas burner to reduce the $NO_x$ emissions produced thereby, said burner having a passageway therein terminating in an outlet portion having a substantially constant cross-sectional area, said burner having flame stabilizing means comprising a non-perforated member having a convex surface facing upstream and positioned within said outlet portion so as to be totally received therein and substantially obstruct the central portion thereof forming an annular area between the periphery of said flame stabilizing means and the surface defining said outlet portion, said method comprising the steps of:

a) premixing air and gas in a manner such that the resulting mixture is substantially homogeneous and contains excess air;

b) increasing the velocity of said substantially homogeneous air/gas mixture through said passageway to a velocity substantially in excess of the velocity where the flame would lift off the outlet of the burner if said flame stabilizing means is absent;

c) igniting said substantially homogeneous air/gas mixture to produce a flame adjacent said annular area and on the downstream side of said flame stabilizing means; and d) continuing the flow of said substantially constant air/gas mixture through said passageway at said velocity substantially in excess of said flame lift off velocity.

6. The method as defined in claim 5 wherein said flame stabilizing means provides a combustion sustaining quiescent zone within said substantially homogeneous air/gas mixture on the downstream side of said flame stabilizing means.

7. The method as defined in claim 6 wherein the velocity of said substantially homogeneous air/gas mixture within said combustion sustaining quiescent zone is less than the velocity of said substantially homogeneous air/gas mixture outside said zone, said velocity of said substantially homogeneous air/gas mixture outside said zone being substantially greater than the velocity at which the flame would lift off the outlet of the burner if said flame stabilizing means is absent.

8. A gas burner which produces a low level of $NO_x$ emissions comprising a body portion having a passageway therein, an outlet portion fluidically connected to said passageway, said outlet portion having a substantially constant cross-sectional area, and flame stabilizing means positioned within said outlet portion so as to be totally received therein and substantially obstruct the central portion thereof forming an annular area between the periphery of said flame stabilizing means and the surface defining said outlet portion.

9. The burner as defined in claim 8 wherein said flame stabilizing means comprises a bluff body.

* * * * *

UNITED STATES PATENT AND TRADEMARK OFFICE

CERTIFICATE OF CORRECTION

PATENT NO. : 5,236,327

DATED August 17, 1993

INVENTOR(S) Paul Flanagan

It is certified that error appears in the above-indentified patent and that said Letters Patent is hereby corrected as shown below:

On the title page, item [75] Inventors: should read as follows:

--[75] Inventor: Paul Flanagan, Northfield Center, Ohio--.

Signed and Sealed this

Fifteenth Day of March, 1994

*Attest:*

Bruce Lehman

BRUCE LEHMAN

*Attesting Officer*

*Commissioner of Patents and Trademarks*